US010087699B2

(12) United States Patent
Gagne

(10) Patent No.: US 10,087,699 B2
(45) Date of Patent: Oct. 2, 2018

(54) DIVERTER ASSEMBLIES AND SYSTEMS FOR FORMING SEALS AROUND PIPE ELEMENTS AND METHODS OF USING SAME

(71) Applicant: Longyear TM, Inc., South Jordan, UT (US)

(72) Inventor: Lee Gagne, Cobalt (CA)

(73) Assignee: LONGYEAR TM, INC., Salt Lake City, UT (US)

( * ) Notice: Subject to any disclaimer, the term of this patent is extended or adjusted under 35 U.S.C. 154(b) by 409 days.

(21) Appl. No.: 14/585,736

(22) Filed: Dec. 30, 2014

(65) Prior Publication Data

US 2015/0184478 A1 Jul. 2, 2015

Related U.S. Application Data

(60) Provisional application No. 61/921,869, filed on Dec. 30, 2013.

(51) Int. Cl.
*E21B 33/06* (2006.01)

(52) U.S. Cl.
CPC ..... *E21B 33/062* (2013.01)

(58) Field of Classification Search
CPC ..... E21B 33/062; E21B 33/06
See application file for complete search history.

(56) References Cited

U.S. PATENT DOCUMENTS 4,081,027 A 3/1978 Nguyen
4,332,367 A * 6/1982 Nelson ..... E21B 33/062 251/1.3
4,582,293 A 4/1986 Jones
5,833,208 A * 11/1998 Lee, Jr. ..... E21B 33/062 251/1.1
2006/0021749 A1 2/2006 Schaeper
2006/0278406 A1 12/2006 Judge et al.
2007/0137866 A1* 6/2007 Ravensbergen ..... E21B 19/22 166/384
2012/0012339 A1 1/2012 Weir et al.

FOREIGN PATENT DOCUMENTS

WO PCT/US2014/072687 12/2014

OTHER PUBLICATIONS

International Search Report and Written Opinion dated Apr. 1, 2015 for International Patent Application No. PCT/US2014/072687, which was filed on Dec. 30, 2014 (Inventor—Gagne; Applicant—Longyear TM, Inc.) (pp. 1-19).
U.S. Appl. No. 61/921,869, filed Dec. 30, 2013, Gagne (Longyear TM, Inc.).

* cited by examiner

*Primary Examiner* — Taras P Bemko
*Assistant Examiner* — Manuel C Portocarrero
(74) *Attorney, Agent, or Firm* — Ballard Spahr LLP

(57) ABSTRACT

Diverter assemblies having a housing, first and second rams, first and second actuators for moving the rams, and first and second sealing members respectively coupled to the first and second rams. The housing defines openings surrounding a drilling axis and configured to receive a pipe in a drilling position, and the rams are moveable relative to a longitudinal axis of the housing that is substantially perpendicular to the drilling axis. The first and second sealing members engage the pipe, and projections within the housing cooperate with the sealing members to form a seal around the pipe and the openings of the housing. Systems and methods of using the diverter assemblies are also disclosed.

20 Claims, 11 Drawing Sheets

DIVERTER ASSEMBLIES AND SYSTEMS FOR FORMING SEALS AROUND PIPE ELEMENTS AND METHODS OF USING SAME

CROSS-REFERENCE TO RELATED PATENT APPLICATION

This application claims priority to U.S. Provisional Patent Application No. 61/921,869, filed Dec. 30, 2013, which is incorporated by reference herein in its entirety.

FIELD

This invention relates to diverter assemblies and diverter systems for forming seals around pipes during drilling operations to prevent the escape of liquid, gas, or other fluid.

BACKGROUND

Existing diverter assemblies are large, heavy assemblies that are difficult to disassemble and/or transport. Conventional diverter assemblies comprise housings containing sealing elements that form a seal around a drill rod passing through the housing. However, these sealing elements do not completely seal off the housing; thus, unless separate sealing means are provided for the housing, there is a risk of undesired fluid escape. In some drilling operations, two or more different pipe sizes are employed. During these operations, it is difficult to seal off each of the differently sized pipes using existing diverter assemblies and systems. In particular, it is dangerous and difficult to use existing sonic drill rigs when two rod sizes are required.

Thus, there is a need in the pertinent art for smaller and lighter diverter assemblies that can easily be disassembled and transported as needed. There is a further need for diverter assemblies that are capable of simultaneously forming a seal relative to a pipe and a diverter housing. There is still a further need for diverter assemblies and/or systems that are capable of sealing two or more differently sized pipes during drilling operations.

SUMMARY

Described herein, in one aspect, is a diverter assembly for forming a seal around a pipe positioned in a drilling position. The pipe has a longitudinal axis, and in the drilling position, the longitudinal axis of the pipe is substantially aligned with a drilling axis. The diverter assembly can comprise a housing having a longitudinal axis substantially perpendicular to the drilling axis, a top wall, a bottom wall, and opposed first and second end walls connected to the top and bottom walls and spaced apart relative to the longitudinal axis of the housing. The top and bottom walls can define respective openings. The openings can surround the drilling axis and be configured to receive the pipe in the drilling position. The opening of the top wall can be substantially aligned with the opening of the bottom wall. Each end wall can define a slot. The diverter assembly can further comprise first and second rams respectively received within the slots of the first and second end walls of the housing and configured for axial movement relative to the longitudinal axis of the housing. Each ram can have opposed proximal and distal ends, with the proximal end of each ram being positioned more proximal to the drilling axis than the distal end of the ram relative to the longitudinal axis of the housing. The diverter assembly can further comprise first and second actuators respectively operatively coupled to the distal ends of the first and second rams. The first and second actuators can be configured to selectively move the first and second rams relative to the longitudinal axis of the housing. The diverter assembly can further comprise first and second sealing members respectively operatively coupled to the proximal ends of the first and second rams. Each sealing member can define a top surface, a bottom surface, and at least one side wall extending between the top and bottom surface. The at least one side wall can define a recessed portion configured for engagement with the pipe. At least one of the top surface and the bottom surface of each sealing member can be positioned at a selected acute angle relative to the longitudinal axis of the housing. The top and bottom walls of the housing can each define at least one inner projection extending toward the longitudinal axis of the housing. Upon engagement between the first and second sealing members and the pipe, the at least one inner projection of the top and bottom walls can be configured to cooperate with the first and second sealing members to form a seal around the pipe and the openings of the top and bottom walls of the housing.

In another aspect, a diverter system is described. The diverter system can form seals around at least a first pipe and a second pipe when the pipes are in a drilling position. Each pipe can have a longitudinal axis. In the drilling position, the longitudinal axes of the pipes can be substantially aligned with a drilling axis. The second pipe can circumferentially surround the first pipe. The diverter system can comprise at least first and second diverter assemblies configured to form a seal around a respective pipe in the drilling position. Each diverter assembly comprise a housing having a longitudinal axis substantially perpendicular to the drilling axis, a top wall, a bottom wall, the top and bottom walls defining respective openings. The openings can surround the drilling axis and be configured to receive a pipe in the drilling position. The opening of the top wall of the housing of each diverter assembly can be substantially aligned with the opening of the bottom wall of the housing. The top and bottom walls of the housing of each diverter assembly can define at least one inner projection extending toward the longitudinal axis of the housing. Each diverter assembly can further comprise opposed first and second rams configured for axial movement relative to the longitudinal axis of the housing. Each diverter assembly can further comprise first and second actuators respectively operatively coupled to the first and second rams. The first and second actuators can be configured to selectively move the first and second rams relative to the longitudinal axis of the housing.

Each diverter assembly can further comprise first and second sealing members respectively operatively coupled to the first and second rams. The first and second sealing members can be configured for engagement with a pipe in the drilling position. The housings of the first and second diverter assemblies can be operatively coupled such that the first pipe extends through the openings of the housings of both the first and second diverter assemblies. The first diverter assembly can be configured to form a seal around the first pipe. Upon engagement between the first and second sealing members of the first diverter assembly and the first pipe, the at least one inner projection of the top and bottom walls of the first diverter assembly can be configured to cooperate with the first and second sealing members to form a seal around the first pipe and the openings of the top and bottom walls. The second diverter assembly can be configured to form a seal around the second pipe. Upon engagement between the first and second sealing members of the second diverter assembly and the second pipe, the at least one inner projection of the top and bottom walls of the second diverter assembly can be configured to cooperate with the first and second sealing members to form a seal around the second pipe and the openings of the top and bottom walls.

Also described herein, in an additional aspect, is a method for forming seals around at least a first pipe and a second pipe when the pipes are in a drilling position. Each pipe can have a longitudinal axis. In the drilling position, the longitudinal axes of the pipes can be substantially aligned with a drilling axis. The second pipe can circumferentially surround the first pipe. The method can comprise positioning first and second diverter assemblies such that the first pipe extends through both the first and second diverter assemblies and the second pipe extends through the second diverter assembly but does not extend through the first diverter assembly. Each diverter assembly can comprise a housing having a longitudinal axis substantially perpendicular to the drilling axis, a top wall, a bottom wall, the top and bottom walls defining respective openings. The openings can surround the drilling axis and can be configured to receive a pipe in the drilling position. The opening of the top wall of the housing of each diverter assembly can be substantially aligned with the opening of the bottom wall of the housing. The top and bottom walls of the housing of each diverter assembly can each define at least one inner projection extending toward the longitudinal axis of the housing. Each diverter assembly can further comprise opposed first and second rams configured for axial movement relative to the longitudinal axis of the housing of each diverter assembly. Each diverter assembly can further comprise first and second actuators respectively operatively coupled to the first and second rams. The first and second actuators can be configured to selectively move the first and second rams relative to the longitudinal axis of the housing. Each diverter assembly can further comprise first and second sealing members respectively operatively coupled to the first and second rams. The first and second sealing members of each diverter assembly can be configured for engagement with a pipe in the drilling position. The method can further comprise selectively axially advancing the first and second rams of the first diverter assembly to form a seal around the first pipe. Upon engagement between the first and second sealing members of the first diverter assembly and the first pipe, the at least one inner projection of the top and bottom walls of the first diverter assembly can cooperate with the first and second sealing members to form a seal around the first pipe and the openings of the top and bottom walls. The method can further comprise selectively axially advancing the first and second rams of the second diverter assembly to form a seal around the second pipe. Upon engagement between the first and second sealing members of the second diverter assembly and the second pipe, the at least one inner projection of the top and bottom walls of the second diverter assembly can cooperate with the first and second sealing members to form a seal around the second pipe and the openings of the top and bottom walls.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE FIGURES

These and other features of the preferred embodiments of the invention will become more apparent in the detailed description in which reference is made to the appended drawings wherein.

DETAILED DESCRIPTION

Figure 1:
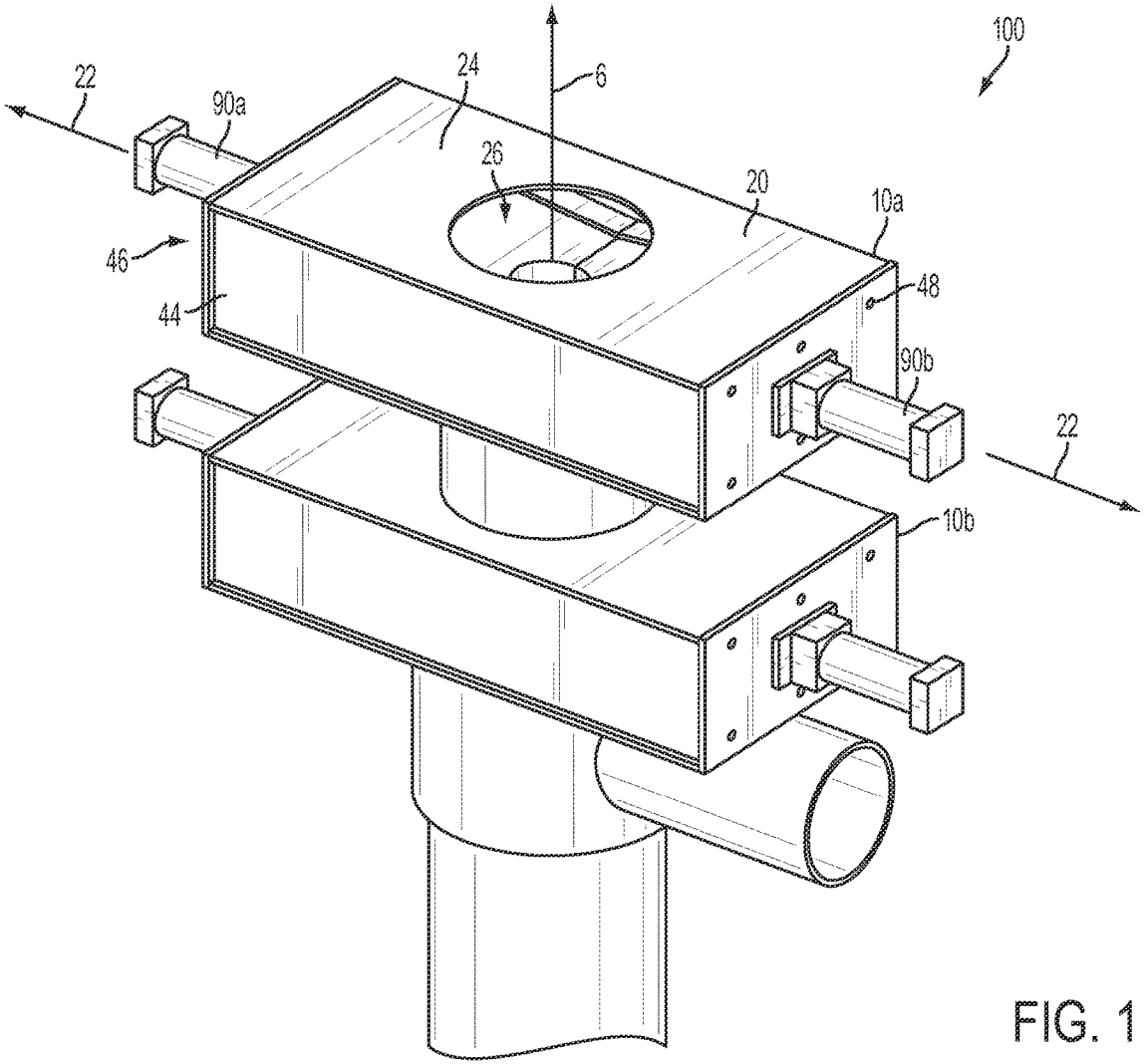
FIG. 1 is a perspective view of an exemplary diverter system as disclosed herein.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a wall" can include two or more such walls unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

Described herein with reference to FIGS. 1-10B are diverter assemblies 10 and diverter systems 100 for forming seals around one or more pipe elements 2 when the pipe elements are positioned in a drilling position. It is contemplated that each pipe 2 can have a longitudinal axis 4, wherein in the drilling position, the longitudinal axis of each pipe is substantially aligned with a drilling axis 6. In operation, it is contemplated that the seals formed using the disclosed diverter assemblies 10 and diverter systems 100 can permit flow of gas, liquid, or other fluids through an outlet conduit (See FIGS. 1 and 4-5) positioned below the diverter assemblies and/or diverter systems within a drilling formation.

Diverter Assemblies

In one aspect, and with reference to FIGS. 1-7, a diverter assembly 10 can comprise a housing 20. In this aspect, the housing 20 can have a longitudinal axis 22 substantially perpendicular to the drilling axis 6, a top wall 24, and a bottom wall 34. It is contemplated that the housing 20 can have at least one side wall 44 connected to the top and bottom walls 24, 34. In exemplary aspects, it is contemplated that the housing 20 can have a longitudinal length (measured relative to the longitudinal axis 22 of the housing) ranging from about 20 inches to about 30 inches. In these aspects, it is optionally contemplated that the longitudinal length of the housing 20 can range from about 23 inches to about 27 inches. In other exemplary aspects, it is contemplated that the housing 20 can have a height (measured relative to the drilling axis) ranging from about 5 inches to about 10 inches. In these aspects, it is optionally contemplated that the height of the housing 20 can range from about 6 inches to about 9 inches. In still other exemplary aspects, it is contemplated that the housing 20 can have a width (measured relative to a line perpendicular to both the drilling axis 6 and the longitudinal axis 22 of the housing) ranging from about 10 inches to about 20 inches. In these aspects, it is optionally contemplated that the width of the housing 20 can range from about 12 inches to about 18 inches. However, it is contemplated that the dimensions of the housing 20 can be scaled as appropriate for a particular drilling application. The dimensions provided above are exemplary only, and it is contemplated that the dimensions are generally dictated by the operative diameter of the drill pipes being used in conjunction with the disclosed diverter assemblies. It is further contemplated that the size of the pipe can determine the stroke (length) needed to provide sufficient clearance between the sealing elements and the pipe when the drill pipe moves in and out of the housing (up and down relative to the drilling axis).

It is contemplated that the overall size and weight of the housing is configured to reduce the overall weight of the diverter assembly and minimize the overall height of the diverter assembly to permit placement of the diverter assembly under a drill rig. It is further contemplated that the weight and dimensions of the housing can be significantly less than those of conventional pipe rams, which typically weight at least 1,000 pounds. In exemplary aspects, it is contemplated that the total weight of a single diverter assembly can be about 200 pounds, with the total weight of two diverter assemblies, a connector, hoses, and fasteners (an exemplary diverter system) being about 500 pounds. It is still further contemplated that, unlike pipe rams, which are designed to hold pressure during operation, the diverter assemblies (particularly the sealing elements) disclosed herein are not configured to hold pressure during operation. It is still further contemplated that the diverter assembly can be disassembled as desired and transported in an unassembled fashion to permit easier transport of the components of the diverter assembly and eliminate or minimize the need for large equipment during the assembly and disassembly processes. In exemplary aspects, it is contemplated that the cylinder, housing cover, rams, and sealing elements can be removed from the housing of the diverter assembly as a single piece, thereby permitting quick disassembly of the diverter assembly.

In another aspect, the top and bottom walls 24, 34 of the housing 20 can define respective openings 26, 36. In this aspect, the openings 26, 36 of the top and bottom walls 24, 34 of the housing 20 can surround the drilling axis 6. It is contemplated that the openings 26, 36 of the top and bottom walls 24, 34 of the housing 20 can be configured to receive the pipe 2 in the drilling position. It is further contemplated that the opening 26 of the top wall 24 of the housing 20 can be substantially aligned with the opening 36 of the bottom wall 34 of the housing. In exemplary aspects, the openings 26, 36 can each have a diameter ranging from about 8 inches to about 12 inches. In these aspects, it is optionally contemplated that the diameter of the openings 26, 36 can be about 10 inches. However, it is contemplated that the openings 26, 36 can be sized as needed to accommodate pipe elements of any size. It is further contemplated that a drill operator can use the diverter assembly to align the pipe in a centered position within a drill hole, thereby allowing for easy connection and disconnection of drill pipe.

Figure 6A:
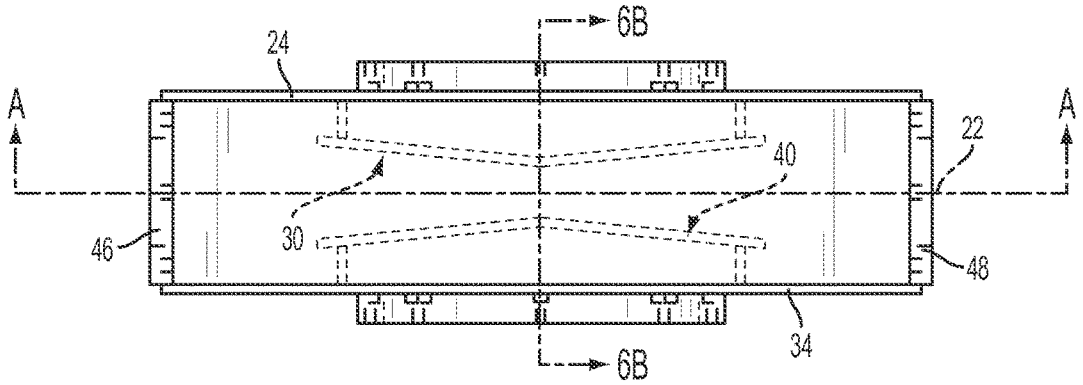
FIGS. 6A-6C depict various perspective and elevational views of an exemplary housing for a diverter assembly as disclosed herein.
Figure 6B:
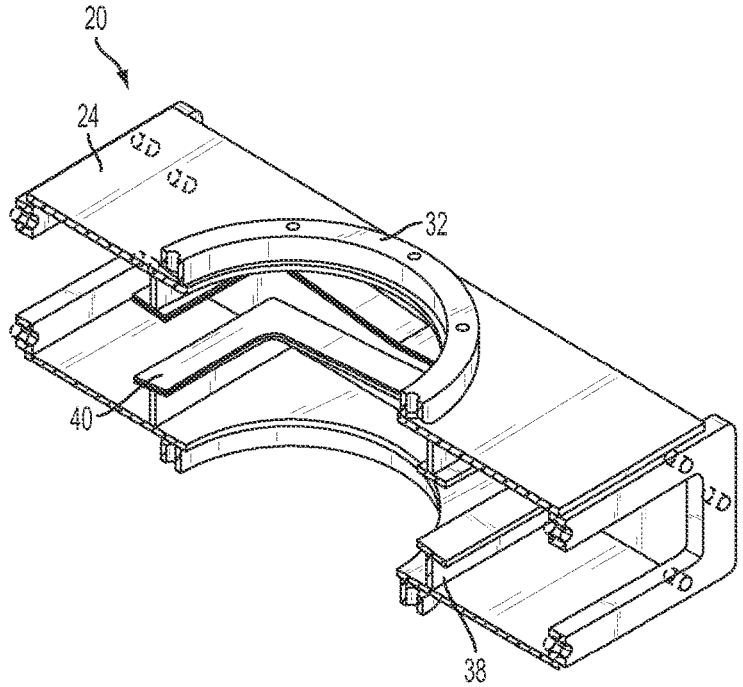
Figure 6C:
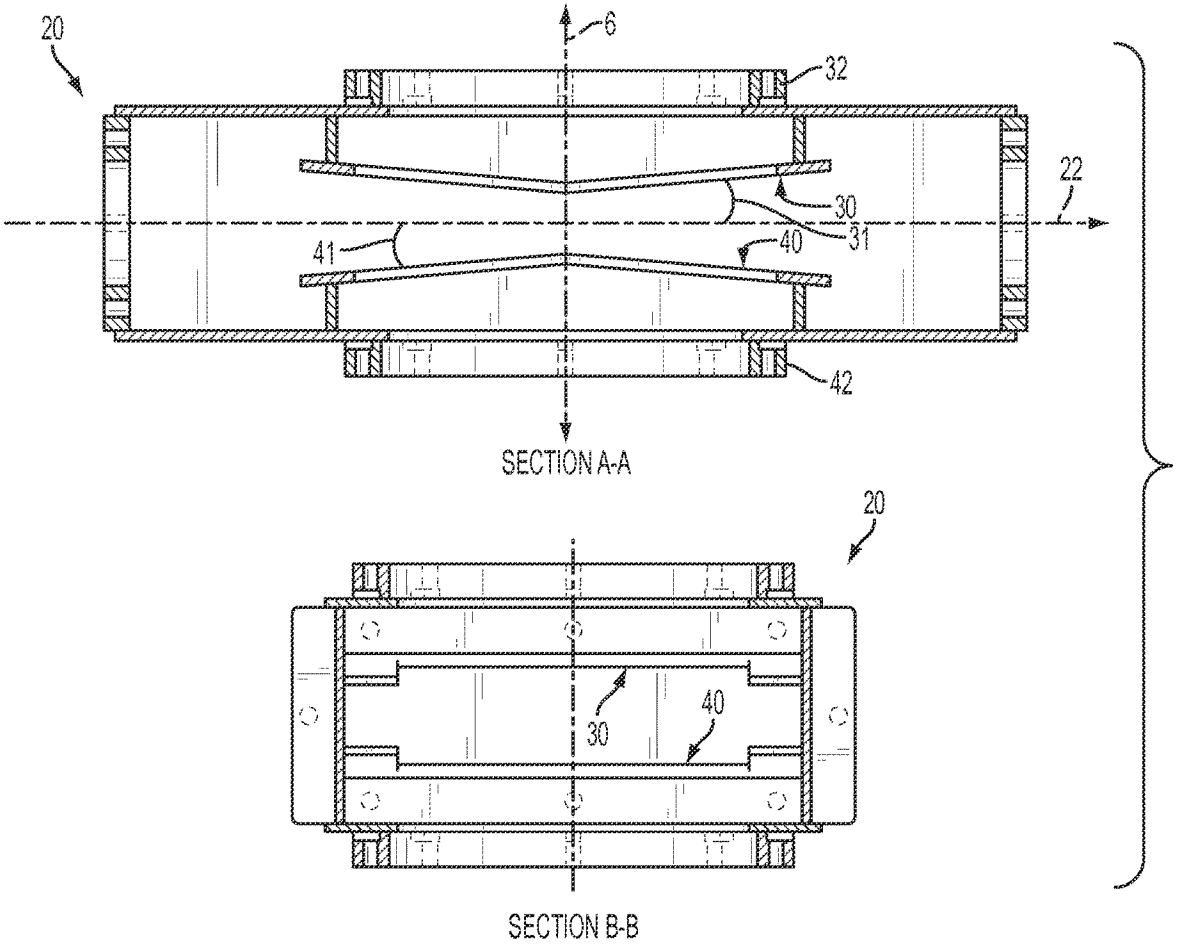

In exemplary aspects, the at least one side wall 44 can comprise opposed first and second end walls 46, 48 spaced apart relative to the longitudinal axis 22 of the housing 20. Optionally, in these aspects, each end wall 46, 48 can define a slot 47, 49. In some exemplary aspects, as shown in FIGS. 6A-6B, the first and second end walls 46, 48 can comprise respective frames secured to the top and bottom walls 24, 34 of the housing 20. As shown in FIG. 1, it is further contemplated that the first and second end walls 46, 48 can further comprise respective cover plates operatively and detachably secured to the frames of the first and second end walls. In exemplary aspects, the frames can define respective central openings, and the cover plates can define the slots 47, 49 of the end walls 46, 48. In these aspects, the slots 47, 49 can cooperate with the central openings of the frames to provide communication with an interior of the housing 20. It is contemplated that the cover plates can be configured for selective attachment and detachment to the frames of the housing 20. Thus, it is further contemplated that the cover plates and frames can permit easy and quick assembly or disassembly of the housings, thereby permitting efficient transport and/or adjustment of the housings. In exemplary aspects, it is contemplated that the housings can be made symmetrical relative to the drilling axis and/or the longitudinal axis of the housing to reduce confusion and/or mistake during assembly of the diverter assembly in the field.

In exemplary aspects, at least one of the top and bottom walls 24, 34 of the housing 20 can define a mounting element 32, 42 surrounding an opening 26, 36 of the housing and extending away from the longitudinal axis 22 of the housing. In these aspects, it is contemplated that each mounting element 32, 42 can optionally circumferentially surround a respective opening 26, 36 of the housing 20. In exemplary aspects, each mounting element 32, 42 can have a radial thickness (measured relative to the drilling axis) ranging from about 1 inch to about 3 inches. In these aspects, it is optionally contemplated that the radial thickness of the mounting elements 32, 42 can be about 2 inches. In exemplary aspects, it is contemplated that the inner diameter of the mounting elements 32, 42 can be larger than the diameters of the openings 26, 36 of the housing 20.

In an additional aspect, as shown in FIGS. 2-5, the diverter assembly 10 can comprise first and second rams 50*a*, 50*b* configured for axial movement relative to the longitudinal axis 22 of the housing 20. Optionally, in this aspect, the first and second rams 50*a*, 50*b* can be respectively received within the slots 47, 49 of the first and second end walls 46, 48 of the housing 20. In exemplary aspects, each ram 50*a*, 50*b* can have opposed proximal and distal ends 52, 54, with the proximal end 52*a*, 52*b* of each ram being positioned more proximal to the drilling axis 6 than the distal end 54*a*, 54*b* of the ram relative to the longitudinal axis 22 of the housing 20. In additional exemplary aspects, it is contemplated that each ram 50*a*, 50*b* can comprise a shaft extending between the proximal and distal ends 52, 54, with the proximal and distal ends having a larger radial thickness (measured relative to the longitudinal axis 22 of the housing 20) than the shaft.

Figure 4:
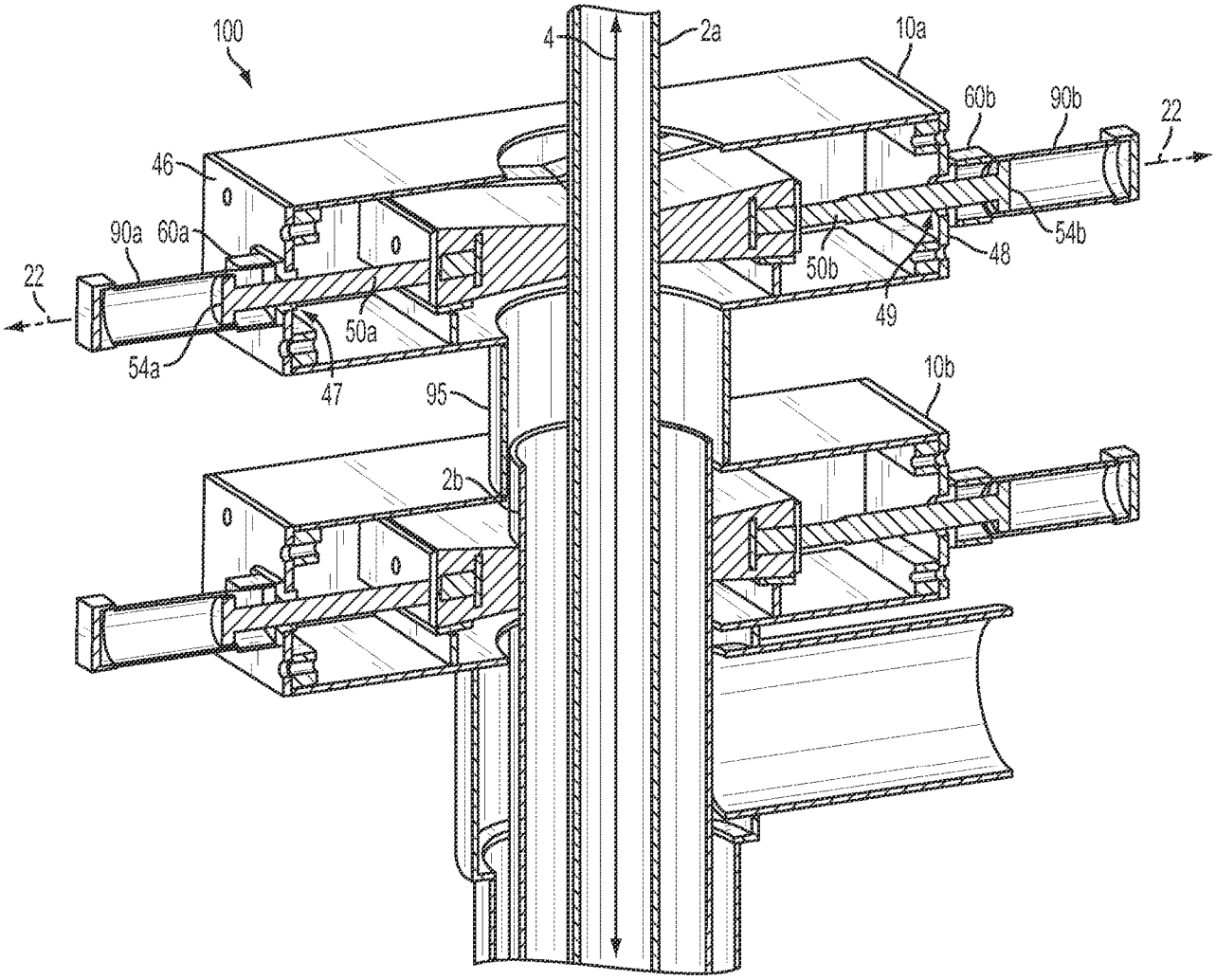
FIG. 4 is a cross-sectional perspective view of an exemplary diverter system as disclosed herein.
Figure 5:
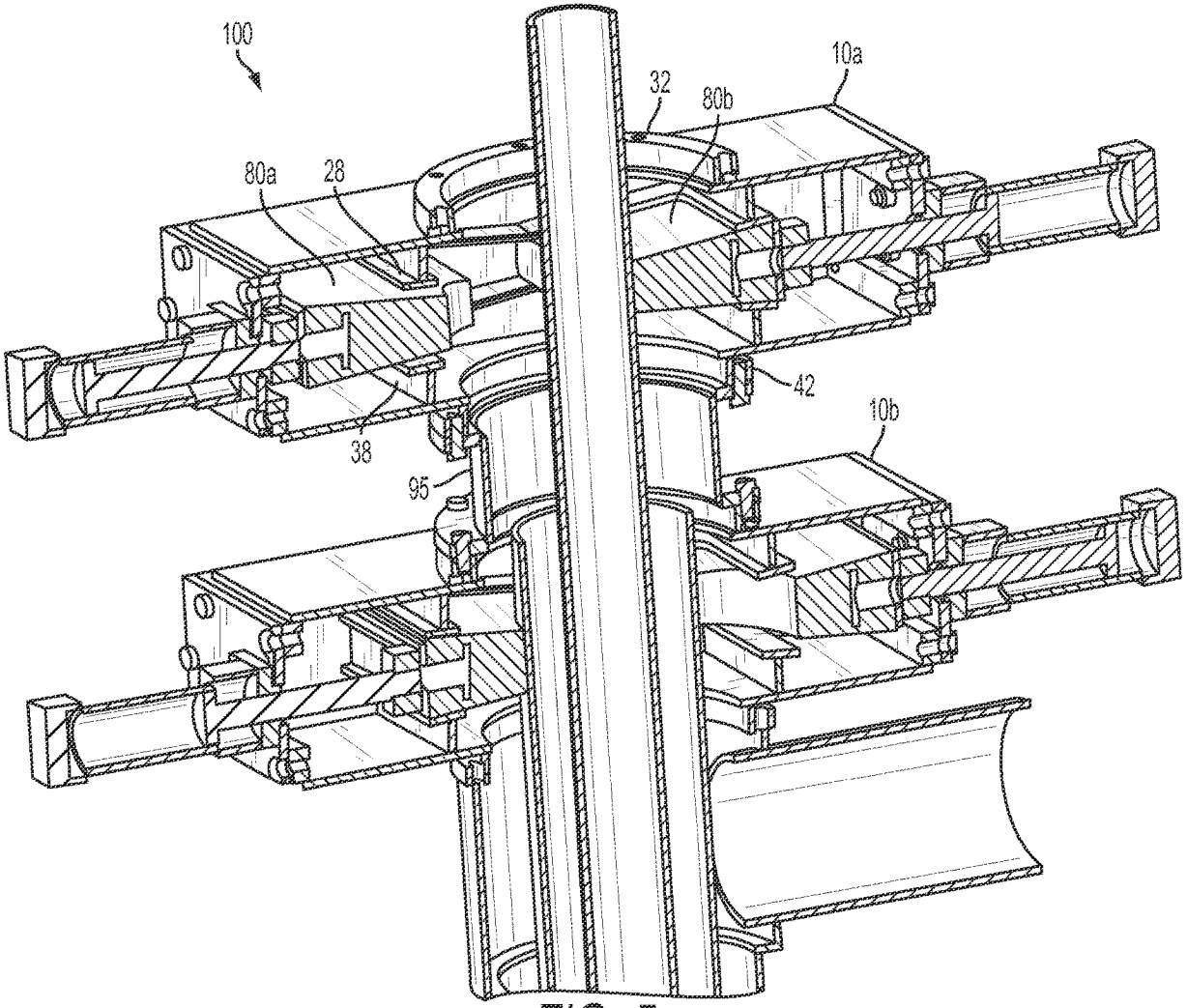
FIG. 5 is a cross-sectional perspective view of another exemplary diverter system as disclosed herein.

In further aspects, and with reference to FIGS. 1 and 4-5, the diverter assembly 10 can comprise first and second actuators 60*a*, 60*b* respectively operatively coupled to the first and second rams 50*a*, 50*b*. Optionally, in these aspects, it is contemplated that the first and second actuators 60*a*, 60*b* can be respectively operatively coupled to the distal ends 54*a*, 54*b* of the first and second rams 50*a*, 50*b*. It is further contemplated that the first and second actuators 60*a*, 60*b* can be configured to selectively move the first and second rams 50*a*, 50*b* relative to the longitudinal axis 22 of the housing 20. In exemplary aspects, the first and second actuators 60*a*, 60*b* can comprise hydraulic actuators. However, it is contemplated that any conventional actuator (mechanical, electrical, pneumatic, etc.) can be used to effect movement of the first and second rams relative to the longitudinal axis of the housing. In exemplary, non-limiting aspects, it is contemplated that the actuators can be conventional hydraulic cylinders having a 2 inch inside diameter and a 1 inch rod, with a stroke of 4 inches. It is contemplated that these size characteristics can be configured to produce a force sufficient to push the sealing elements together as disclosed herein. An exemplary, non-limiting operative pressure for each hydraulic cylinder can be about 800 psi.

In additional aspects, and with reference to FIGS. 2-5 and 8A-9, the diverter assembly 10 can comprise first and second sealing members 80*a*, 80*b* respectively operatively coupled to the first and second rams 50*a*, 50*b*. In these aspects, it is contemplated that the first and second sealing members 80*a*, 80*b* can be respectively operatively coupled to the proximal ends 52*a*, 52*b* of the first and second rams 50*a*, 50*b*. In exemplary aspects, the first and second sealing members 80*a*, 80*b* can be respectively molded into the sealing elements 50*a*, 50*b*, thereby permitting attachment of ram mounts 45 as further described herein.

In additional exemplary aspects, each sealing member 80*a*, 80*b* can define a top surface 82*a*, 82*b*, a bottom surface 84*a*, 84*b*, and at least one side wall 86*a*, 86*b* extending between the top and bottom surface. In these aspects, the at least one side wall 86*a*, 86*b* can define a recessed portion 88*a*, 88*b* configured for engagement with the pipe 2. It is contemplated that the recessed portion 88*a*, 88*b* can optionally have an arcuate shape that defines a substantially semi-circular void space. In exemplary aspects, it is contemplated that the recessed portion 88*a*, 88*b* can have a radius of curvature ranging from about 1 inch to about 3 inches. In these aspects, it is further contemplated that the radius of curvature can optionally range from about 1.5 inches to about 2 inches. It is further contemplated that the radius of curvature can optionally be about 1.75 inches. However, it is contemplated that any radius of curvature can be used, depending upon the size of the rod element to be engaged by the sealing member 80*a*, 80*b*. Optionally, in exemplary aspects, upon engagement between the first and second sealing elements 50*a*, 50*b* and the pipe element, it is contemplated that an outer face of the side wall 86*a* that defines the recessed portion 88*a* of the first sealing member 80*a* can be substantially flush with an outer face of the side wall 86*b* that defines the recessed portion 88*b* of the second sealing member 80*b*. Thus, in these aspects, it is contemplated that the first and second sealing members 80*a*, 80*b* can contact one another when a seal is formed around the pipe 2.

In further exemplary aspects, it is contemplated that at least one of the top surface 82*a*, 82*b* and the bottom surface 84*a*, 84*b* of each sealing member 80*a*, 80*b* can be positioned at a selected acute angle 83, 85 relative to the longitudinal axis 22 of the housing 20. In these aspects, it is contemplated that the selected acute angle 83, 85 can range from about 1 degree to about 20 degrees. It is further contemplated that the selected acute angle 83, 85 can range from about 3 degrees to about 10 degrees. It is still further contemplated that the selected acute angle 83, 85 can range from about 4 degrees to about 6 degrees. It is still further contemplated that the selected acute angle 83, 85 can be about 5 degrees. In exemplary aspects, it is contemplated that both the top surface 82*a*, 82*b* and the bottom surface of each sealing member 80*a*, 80*b* can be positioned at the selected acute angle 83, 85 relative to the longitudinal axis 22 of the housing 20. Thus, in other exemplary aspects, it is contemplated that the first and second sealing members 80*a*, 80*b* can be substantially wedge-shaped. In these aspects, it is contemplated that each sealing member 80*a*, 80*b* can have a length (measured relative to the longitudinal axis 22 of the housing 20), a width (measured relative to a line perpendicular to both the drilling axis 6 and the longitudinal axis of the housing), and a variable thickness (measured relative to the drilling axis). In exemplary aspects, it is contemplated that the length of each sealing member 80*a*, 80*b* can range from about 5 inches to about 10 inches, and, more preferably, be about 7.5 inches. In additional exemplary aspects, it is contemplated that the width of each sealing member 80*a*, 80*b* can range from about 10 inches to about 15 inches, and more preferably, be about 12.9 inches. In further exemplary aspects, it is contemplated that each sealing member 80*a*, 80*b* can have a minimum thickness proximate the drilling axis 6 and a maximum thickness on an opposed end of the sealing member spaced farthest from the drilling axis relative to the longitudinal axis 22 of the housing 20. In these aspects, it is contemplated that the minimum thickness of each sealing member 80*a*, 80*b* can range from about 1.5 inches to about 2.0 inches. It is further contemplated that the maximum thickness of each sealing member 80*a*, 80*b* can range from about 2 inches to about 4 inches and, more preferably, be about 3 inches.

Optionally, in exemplary aspects, the first and second sealing members 80*a*, 80*b* can comprise a non-metal material, such as, for example and without limitation, urethane. In these aspects, it is contemplated that the use of urethane sealing members 80*a*, 80*b* can permit molding of the steel ram mounts with the sealing members as further disclosed herein. In exemplary aspects, it is contemplated that the non-metallic sealing members can effectively eliminate the possibility of metal-on-metal contact within the diverter assembly, thereby minimizing the risk of sparks. It is further contemplated that, by minimizing the risk of sparks within the diverter assembly, the non-metallic sealing members can increase the safety of the diverter assembly in drilling operations involving flammable gases. In further exemplary aspects, it is contemplated that the hardness of the first and second sealing members 80*a*, 80*b* can range from about 40 to about 60 Durometer A. In these aspects, it is further contemplated that the hardness of the first and second sealing members 80*a*, 80*b* can be about 50 Durometer A.

Figure 9:
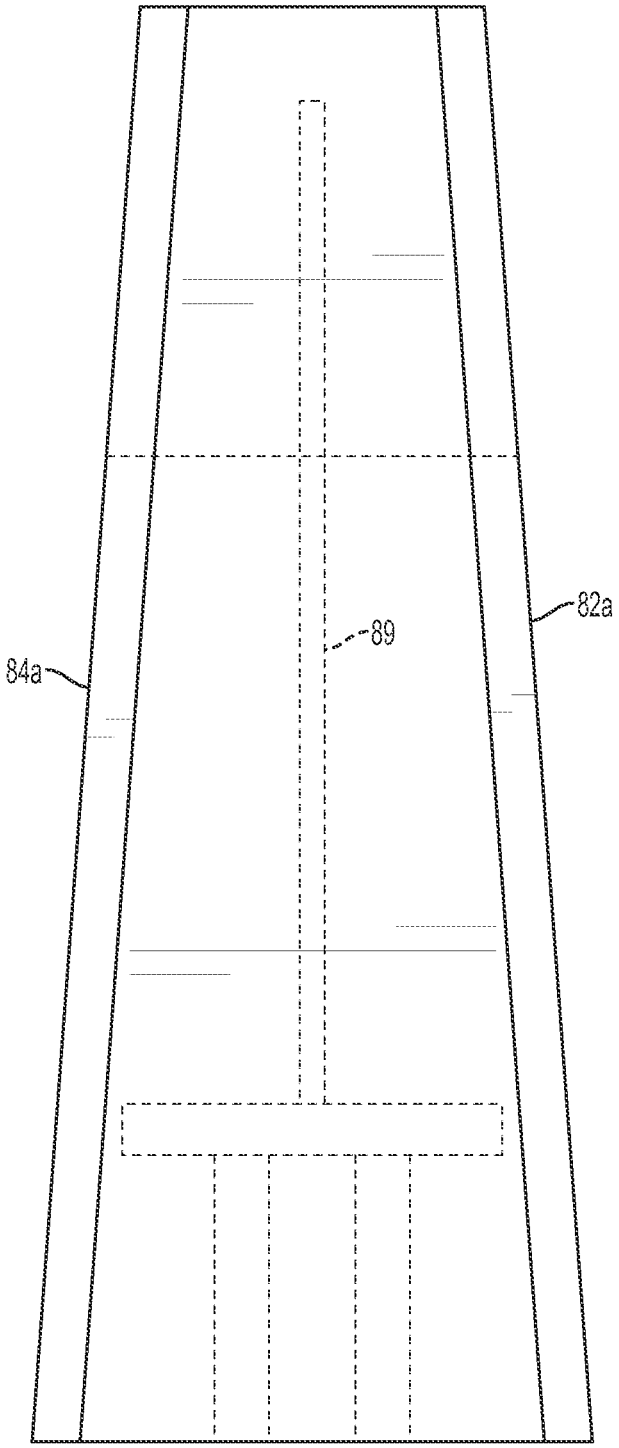
FIG. 9 depicts a side elevation view of an exemplary sealing member of a diverter assembly as disclosed herein, showing a planar stiffening element positioned within the sealing member and extending from a proximal portion towards the side wall having the recessed portions of the sealing member to stiffen the overall sealing member in operation.

As operatively shown in FIG. 9, the first and second sealing members 80*a*, 80*b* can further comprise planar stiffening element 89 positioned within the sealing member and extending from a proximal portion towards the at least one side wall 86*a*, 86*b* of the sealing member having the recessed portions 88*a*, 88*b* configured for engagement with the pipe 2 to stiffen the overall sealing member in operation. In one aspect, the planar stiffening element can comprise a planar metal plate. In another aspect, the stiffening element, as shown in FIG. 9, can be substantially enclosed in the respective first and second sealing members 80*a*, 80*b*.

In exemplary aspects, the top and bottom walls 24, 34 of the housing 20 can each define at least one inner projection 28, 38 extending toward the longitudinal axis 22 of the housing 20. In these aspects, it is contemplated that, upon engagement between the first and second sealing members 80*a*, 80*b* and the pipe 2, the at least one inner projection 28, 38 of the top and bottom walls 24, 34 is configured to cooperate with the first and second sealing members to form a seal around the pipe and the openings 26, 36 of the top and bottom walls of the housing. In some optional exemplary aspects, the at least one inner projection 28, 38 of the top and bottom walls 24, 34 can circumferentially surround the openings 26, 36 defined in the top and bottom walls.

Optionally, in additional exemplary aspects, the at least one inner projection 28 of the top wall 24 can define at least one engagement surface 30 having an angular orientation complementary to the top surfaces 82*a*, 82*b* of the first and second sealing members 80*a*, 80*b*. In these aspects, it is contemplated that the at least one inner projection 38 of the bottom wall 34 can define at least one engagement surface 40 having an angular orientation complementary to the bottom surfaces 84*a*, 84*b* of the first and second sealing members. 80*a*, 80*b* Thus, it is contemplated that the angular orientation of the at least one engagement surface 30, 40 of the inner projections of the top and bottom walls can correspond to an acute angle 31, 41 (measured relative to the longitudinal axis of the housing) ranging from about 1 degree to about 20 degrees. It is further contemplated that the angular orientation of the at least one engagement surface can correspond to an acute angle 31, 41 ranging from about 3 degrees to about 10 degrees. It is still further contemplated that the angular orientation of the at least one engagement surface can correspond to an acute angle 31, 41 ranging from about 4 degrees to about 6 degrees. It is still further contemplated that the angular orientation of the at least one engagement surface can correspond to an acute angle 31, 41 of about 5 degrees. In further aspects, it is contemplated that the angular orientation of the top and/or bottom surfaces of each sealing member and the angular orientation of the engagement surfaces of the inner projections of the top and bottom walls of the housing can permit the sealing members to wedge against the engagement surfaces of the inner projections of the top and bottom walls of the housing.

In further exemplary aspects, the diverter assembly 10 can comprise first and second chambers 90*a*, 90*b* respectively secured to the first and second end walls 46, 48 of the housing and extending away from the drilling axis 6 relative to the longitudinal axis 22 of the housing 20. Optionally, in these aspects, the first and second chambers 90*a*, 90*b* can be respectively positioned in communication with the slots 47, 49 defined by the first and second end walls 46, 48 of the housing 20 and configured to permit axial movement of at least a portion of the first and second rams 50*a*, 50*b* relative to the longitudinal axis 22 of the housing 20.

Figure 10A:
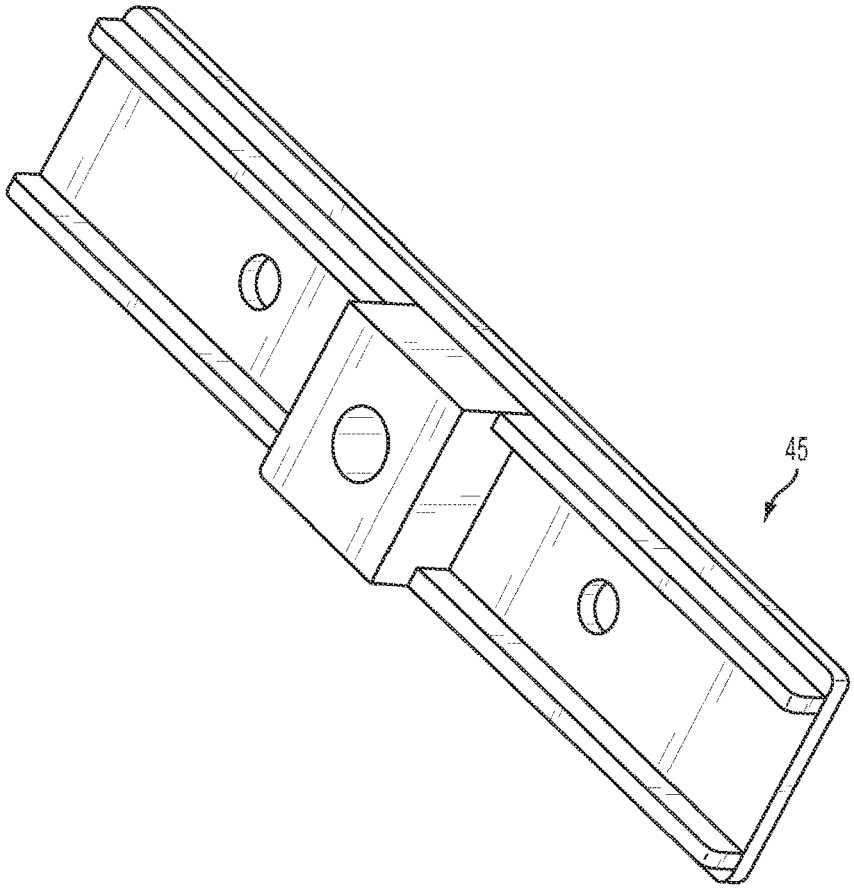
FIGS. 10A and 10B depict a perspective view and a side elevational view of an exemplary ram mount of a diverter assembly as disclosed herein.
Figure 10B:
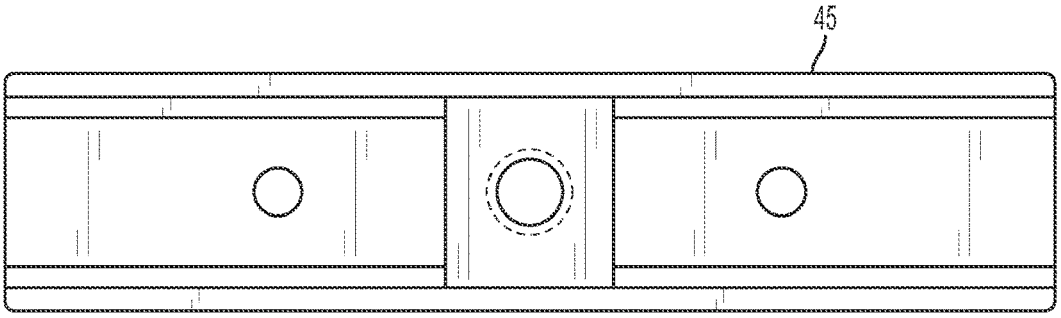

In still further exemplary aspects, and with reference to FIGS. 5, 10A and 10B, the diverter assembly 10 can further comprise first and second ram mounts 45 secured to each respective sealing member 80*a*, 80*b*. In these aspects, it is contemplated that each ram mount 45 can be secured to a respective sealing member 80*a*, 80*b* such that the ram mount effectively defines a distal side wall of the sealing member that is positioned within a plane substantially perpendicular to the longitudinal axis 22 of the housing 20. An outwardly facing surface of each ram mount 45 (facing away from the sealing member 80 to which it is secured) can define a central support portion that projects away from the sealing member and at least two spaced projections extending along a line substantially perpendicular to both the drilling axis and the longitudinal axis of the housing. An inwardly facing surface of each ram mount 45 can be secured substantially flush to the sealing member 80. As shown in FIG. 10, the central support portion can define a bore configured to receive a portion of the shaft of a ram 50. It is contemplated that the bore of the central support portion can have a diameter that is smaller than a radial thickness of the proximal end 52 of each ram 50. Thus, during assembly of the diverter assembly 10, it is contemplated that the proximal end 52 of each ram 50 can be positioned within a corresponding sealing member 80 before the ram mount 45 is secured to the sealing member, thereby permitting the ram mount to secure the proximal end of the ram within the sealing member. In additional aspects, it is contemplated that the ram mounts 45 can define at least one additional bore configured to receive at least one fastener to secure the ram mounts to respective sealing members 80.

Figure 2:
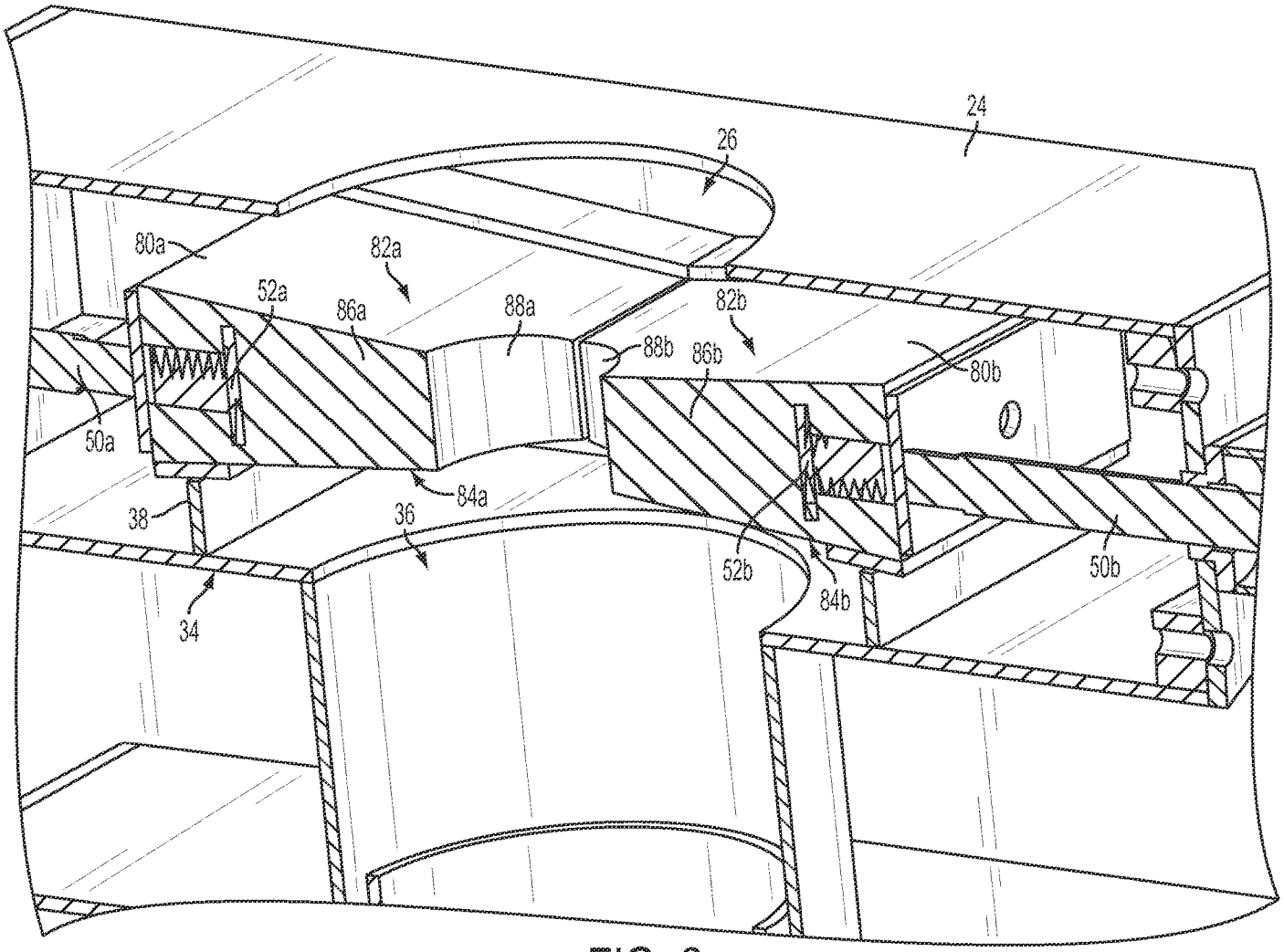
FIG. 2 is a cross-sectional top perspective view of an exemplary diverter assembly as disclosed herein.
Figure 3:
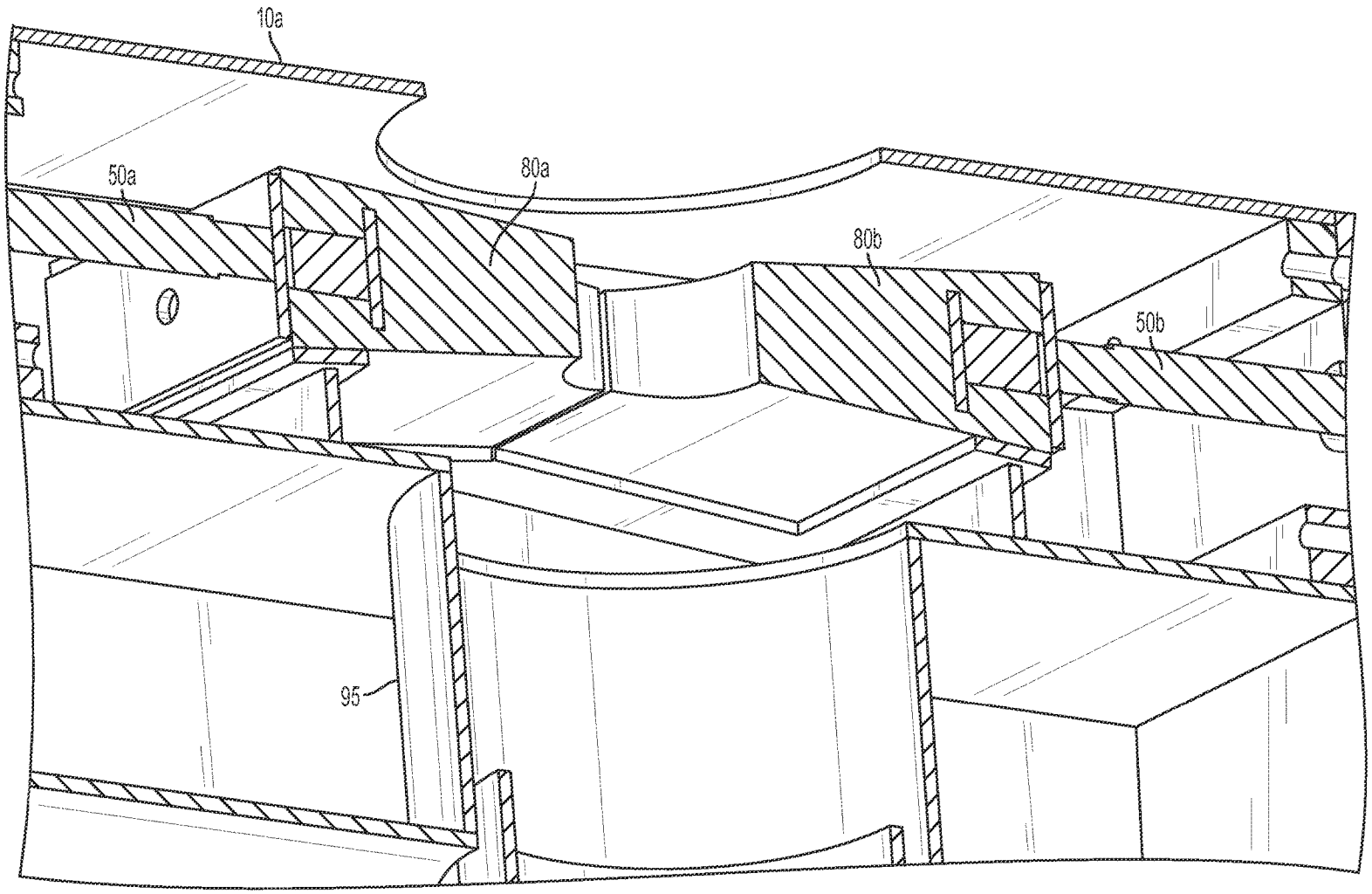
FIG. 3 is a cross-sectional bottom perspective view of an exemplary diverter assembly as disclosed herein.

During drilling operations, it is contemplated that the void space defined by inner projections 28, 38 and the various walls of the housing (see, for example, the void space to the left of projection 38 depicted in FIG. 2) can be configured to receive and collect drill cuttings, such as, for example and without limitation, fine sand mixed with water that comes back out of the drill hole. It is contemplated that the collection of the drill cuttings in this void space can prevent the cuttings from jamming the sealing elements and engagement surfaces 30, 40.

Diverter Systems

In one aspect, as shown in FIGS. 1 and 4-5, a diverter system 100 can comprise at least first and second diverter assemblies 10*a*, 10*b* as disclosed herein. In this aspect, it is contemplated that the first diverter assembly 10*a* can be configured to form a seal around a first pipe 2*a*, while the second diverter assembly 10*b* can be configured to form a seal around a second pipe 2*b*. It is further contemplated that the second pipe 2*b* can circumferentially surround the first pipe 2*a*.

In exemplary aspects, the housings of the first and second diverter assemblies 10*a*, 10*b* can be operatively coupled such that the first pipe 2*a* extends through the openings of the housings of both the first and second assemblies. In these aspects, it is further contemplated that the second pipe 2*b* can extend through the openings of the second housing but not extend through an opening of the first housing. In further exemplary aspects, it is contemplated that the first pipe 2*a* can be a drill rod, while the second pipe 2*b* can be an inner casing of a drill string. In operation, when the second pipe is connected to a drill head and being drilled into the ground, it is contemplated that the second pipe 2*b* (e.g., a casing) can extend through the openings of the first and second housings. However, when the joint of the second pipe (e.g., casing) is broken and the first pipe 2*a* (e.g., drill rod) is to be advanced, the joint of the second pipe can be positioned as shown in FIG. 4 (within the connector 95 between the first and second diverter assemblies) so that the top diverter assembly can seal around the second pipe (e.g., drill rod) if gas is intersected or otherwise encountered. If the end of the casing is place too low or two high (outside of the connector), then it is contemplated that gas can come up between the casing and the rod, thereby preventing the diverter system from working as intended.

In additional exemplary aspects, and as shown in FIGS. 1 and 4-5, it is contemplated that the diverter system 100 can comprise at least one connector 95 configured to operatively couple a first housing to a second housing. Optionally, in these aspects, it is contemplated that the connector 95 can be permanently secured and/or integrally formed with the first and second housings. However, in other aspects, it is contemplated that the connector 95 can optionally be detachably secured to the housings proximate openings of the housing. For example, in these aspects, as shown in FIG. 5, it is contemplated that the connector 95 can be detachably secured to mounting elements of the first and second housings.

In another aspect, the first diverter assembly 10*a* can be configured to form a seal around the first pipe 2*a*. In this aspect, it is contemplated that, upon engagement between the first and second sealing members of the first diverter assembly 10*a* and the first pipe, the at least one inner projection of the top and bottom walls of the first diverter assembly can be configured to cooperate with the first and second sealing members to form a seal around the first pipe and the openings of the top and bottom walls of the first housing.

In a further aspect, the second diverter assembly 10*b* can be configured to form a seal around the second pipe 2*b*. In this aspect, it is contemplated that, upon engagement between the first and second sealing members of the second diverter assembly 10*b* and the second pipe 2*b*, the at least one inner projection of the top and bottom walls of the second diverter assembly can be configured to cooperate with the first and second sealing members to form a seal around the second pipe and the openings of the top and bottom walls.

As further disclosed herein, and as depicted in FIGS. 1 and 4-5, it is contemplated that the seals formed using the disclosed diverter assemblies 10 and diverter systems 100 can permit flow of gas, liquid, or other fluids through an outlet conduit positioned below the diverter assemblies and/or diverter systems within a drilling formation. It is further contemplated that the outlet conduit can allow fluid to flow when one of the diverter assemblies of the diverter system is closed.

Although the use of urethane sealing members as disclosed herein can minimize the number of steel-to-steel joints within the diverter system, it is contemplated that the diverter system can nonetheless comprise steel-to-steel joints. Thus, it is contemplated that the diverter system can comprise a plurality of urethane gaskets, with each urethane gasket being configured for placement at a selected steel-to-steel joint within the system.

Figure 7:
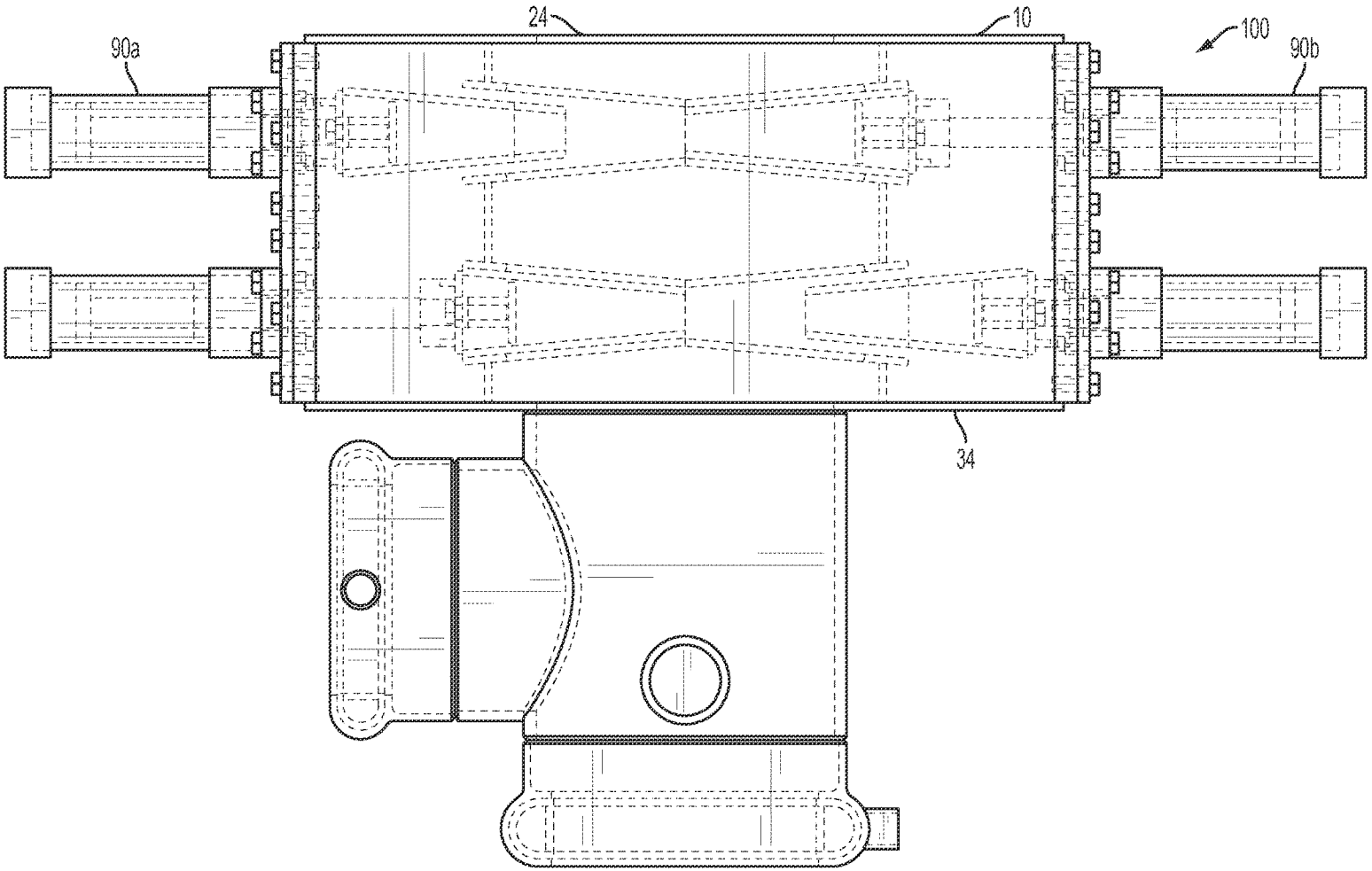
FIG. 7 is a cross-sectional side elevational view of an exemplary diverter system showing first and second diverter assemblies operatively mounted therein a single housing. The first and second diverter assemblies are positioned in stacked position relative to the drilling axis.
Figure 8A:
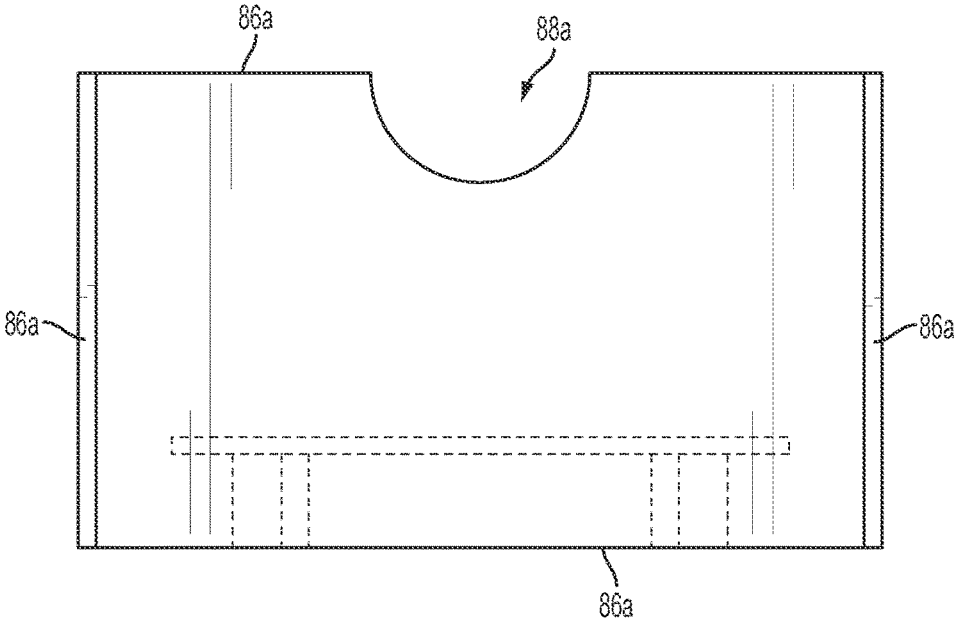
FIGS. 8A and 8B depict various perspective and elevational views of an exemplary sealing member of a diverter assembly as disclosed herein.
Figure 8B:
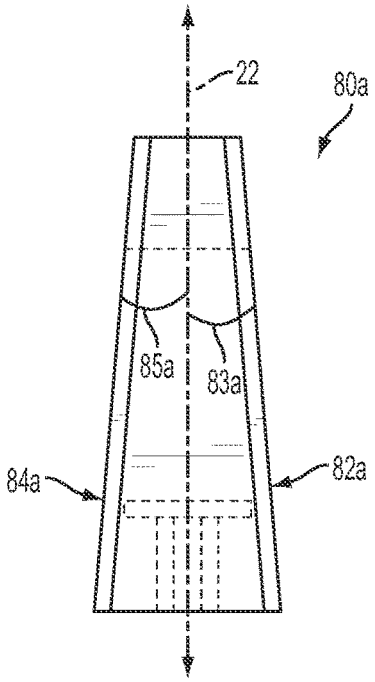

In another aspect, as shown in FIG. 7, the diverter system 100 can comprise at least first and second diverter assemblies 10*a*, 10*b* as disclosed herein, which are operatively mounted therein a single housing. In this aspect, it is contemplated that the first diverter assembly 10*a* can be configured to form a seal around a first pipe 2*a*, while the second diverter assembly 10*b* can be configured to form a seal around a second pipe 2*b*. It is further contemplated that the second pipe 2*b* can circumferentially surround the first pipe 2*a*. This configuration allows for an additional reduction in overall height of the system.

In exemplary aspects, the housing of the first and second diverter assemblies 10*a*, 10*b* shown in FIG. 7 can be operatively coupled such that the first pipe 2*a* extends through the openings of both the first and second diverter assemblies. In these aspects, it is further contemplated that the second pipe 2*b* can extend through the bottom opening 36 of the housing 20 but short of the opening of the first diverter assembly 10*a*. In further exemplary aspects, it is contemplated that the first pipe 2*a* can be a drill rod, while the second pipe 2*b* can be an inner casing of a drill string. In operation, when the second pipe is connected to a drill head and being drilled into the ground, it is contemplated that the second pipe 2*b* (e.g., a casing) can extend through the openings of the first and second housings.

In exemplary aspects, the diverter system can comprise a hydraulic control system operatively coupled to the hydraulic actuators of the diverter assemblies. In these aspects, it is contemplated that the first and second diverter assemblies can be plumbed hydraulically to prevent the sealing elements of the first diverter assembly from closing at the same time as the sealing elements of the second diverter assembly. It is further contemplated that this feature can minimize the risk of gas being trapped within the connector area (below the top sealing elements and above the bottom sealing elements). In exemplary aspects, the hydraulic control system can be configured to permit the closing of only a single set of sealing members at a given time, thereby preserving a flow path for the fluid within the diverter system to exit the system through the outlet conduit under the bottom diverter assembly. Thus, for example, with reference to FIGS. 1 and 4-5, it is contemplated that when the top set of sealing members is closed around a drill rod, the bottom set of sealing members cannot be closed. It is contemplated that this feature is especially important when the casing ends below the top diverter assembly, as shown in FIGS. 4-5.

In exemplary aspects, it is contemplated that the hydraulic system can comprise pilot lines plumbed at the end of directional control valves, with a directional control valve being operatively coupled to each respective hydraulic actuator (cylinder). In use, if one set of sealing members is closed (for example, using at least one of the top directional control valves), the handle of the bottom directional control valves cannot be physically moved due to the pressure by the pilot line from the top directional control valves. It is contemplated that the hydraulic system can operate in the opposite direction when trying to close the top sealing members while the bottom sealing members are closed.

It is contemplated that the hydraulic control system can comprise conventional components, including, for example and without limitation, one or more charge valves, one or more pressure reducing valves, directional control valves with pilots as disclosed herein, one or more accumulators, one or more manifolds, one or more pressure gauges, one or more check valves, hydraulic cylinders as disclosed herein, and one or more hydraulic hoses and fittings. It is contemplated that the accumulator can be configured to serve as a backup power source if the drill shuts down and there is no hydraulic power source available to operate the cylinders.

Although described herein with reference to first and second diverter assemblies, it is contemplated that the diverter system can comprise any number of diverter assemblies required to perform a particular drilling operation. For example, in exemplary aspects, it is contemplated that at least one diverter assembly can be provided for each differently sized pipe used during a drilling operation.

Methods of Using the Disclosed Diverter Assemblies and Diverter Systems

In use, it is contemplated that the disclosed diverter assemblies and diverter systems can be selectively operated to form seals around one or more pipe elements. In exemplary aspects, a diverter system comprising at least first and second diverter assemblies can be used to perform a method for forming seals around at least a first pipe and a second pipe when the pipes are in a drilling position. In these aspects, it is contemplated that each pipe can have a longitudinal axis, and in the drilling position, the longitudinal axes of the pipes can be substantially aligned with a drilling axis. It is further contemplated that the second pipe can circumferentially surround the first pipe. Optionally, it is contemplated that the first pipe can be a drill rod, while the second pipe can be an inner casing.

In one aspect, the method can comprise positioning the first and second diverter assemblies such that the first pipe extends through both the first and second diverter assemblies and the second pipe extends through the second diverter assembly but does not extend through the first diverter assembly. In another aspect, the method can comprise selectively axially advancing the first and second rams of the first diverter assembly to form a seal around the first pipe. In this aspect, it is contemplated that, upon engagement between the first and second sealing members of the first diverter assembly and the first pipe, the at least one inner projection of the top and bottom walls of the first diverter assembly can cooperate with the first and second sealing members to form a seal around the first pipe and the openings of the top and bottom walls. In a further aspect, the method can comprise selectively axially advancing the first and second rams of the second diverter assembly to form a seal around the second pipe. In this aspect, it is contemplated that, upon engagement between the first and second sealing members of the second diverter assembly and the second pipe, the at least one inner projection of the top and bottom walls of the second diverter assembly can cooperate with the first and second sealing members to form a seal around the second pipe and the openings of the top and bottom walls.

In exemplary aspects, it is contemplated that the diverter assemblies and diverter systems disclosed herein can be used in conjunction with a sonic drill rig. However, it is contemplated that the disclosed assemblies and systems can be used effectively with any conventional drill rig.

In exemplary applications, it is contemplated that the diverter assemblies and diverter systems disclosed herein can effectively contain harmful and/or dangerous fluids (such as, for example, and without limitation, hydrogen sulfide gas) that are encountered during drilling operations. In these applications, it is contemplated that these harmful and/or dangerous fluids can be effectively contained when the drilling operations require the use of more than one size of pipe. In further exemplary applications, it is contemplated that the minimal weight and dimensions of the disclosed diverter assemblies are more easily transported, handled, assembled, and disassembled than conventional diverter assemblies and pipe rams.

Experimental Examples

In exemplary, non-limiting aspects, it is contemplated that the actuators can be conventional hydraulic cylinders having a 2 inch inside diameter and a 1 inch rod, with a stroke of 4 inches. It is contemplated that these size characteristics can be configured to produce a force sufficient to push the sealing elements together as disclosed herein. In experimental testing of these actuators, the design pressure on the cylinders was originally set at 300 psi. After testing, the pressure was increased to 800 psi on each cylinder, and these parameters resulted in the creation of a proper seal.

Testing in the field was conducted with a sonic rig that drilled two separate holes into the tar sands in northern Alberta. The diverter system worked properly with no issues encountered. Once both holes were completed, the diverter assembly was disassembled and inspected for wear and contamination. Very little wear was observed on the urethane sealing elements. The drill cuttings collected in the bottom cavities of the housing as expected but did not impede the operation of the diverter assembly.

Exemplary Aspects

In exemplary aspects, a diverter assembly is provided for forming a seal around a pipe positioned in a drilling position, the pipe having a longitudinal axis, wherein in the drilling position, the longitudinal axis of the pipe is substantially aligned with a drilling axis, the diverter assembly comprising: a housing having a longitudinal axis substantially perpendicular to the drilling axis, a top wall, a bottom wall, and opposed first and second end walls connected to the top and bottom walls and spaced apart relative to the longitudinal axis of the housing, the top and bottom walls defining respective openings, the openings surrounding the drilling axis and being configured to receive the pipe in the drilling position, the opening of the top wall being substantially aligned with the opening of the bottom wall, wherein each end wall defines a slot; first and second rams respectively received within the slots of the first and second end walls of the housing and configured for axial movement relative to the longitudinal axis of the housing, each ram having opposed proximal and distal ends, the proximal end of each ram being positioned more proximal to the drilling axis than the distal end of the ram relative to the longitudinal axis of the housing; first and second actuators respectively operatively coupled to the distal ends of the first and second rams, wherein the first and second actuators are configured to selectively move the first and second rams relative to the longitudinal axis of the housing; and first and second sealing members respectively operatively coupled to the proximal ends of the first and second rams, each sealing member defining a top surface, a bottom surface, and at least one side wall extending between the top and bottom surface, the at least one side wall defining a recessed portion configured for engagement with the pipe, wherein at least one of the top surface and the bottom surface of each sealing member is positioned at a selected acute angle relative to the longitudinal axis of the housing, wherein the top and bottom walls of the housing each define at least one inner projection extending toward the longitudinal axis of the housing, and wherein, upon engagement between the first and second sealing members and the pipe, the at least one inner projection of the top and bottom walls are configured to cooperate with the first and second sealing members to form a seal around the pipe and the openings of the top and bottom walls of the housing.

In additional exemplary aspects, the at least one inner projection of the top wall defines at least one engagement surface having an angular orientation complementary to the top surfaces of the first and second sealing members, and wherein the at least one inner projection of the bottom wall defines at least one engagement surface having an angular orientation complementary to the bottom surfaces of the first and second sealing members.

In additional exemplary aspects, the first and second actuators comprise hydraulic actuators.

In additional exemplary aspects, the diverter assembly further comprises first and second chambers respectively secured to the first and second end walls of the housing and extending away from the drilling axis relative to the longitudinal axis of the housing, the first and second chambers being respectively positioned in communication with the slots defined by the first and second end walls of the housing and configured to permit axial movement of at least a portion of the first and second rams relative to the longitudinal axis of the housing.

In additional exemplary aspects, at least one of the top and bottom walls of the housing defines a mounting element surrounding an opening of the housing and extending away from the longitudinal axis of the housing.

In additional exemplary aspects, the first and second sealing members comprise urethane.

In additional exemplary aspects, the first and second sealing members are substantially wedge-shaped.

In another exemplary aspect, a diverter system is provided for forming seals around at least a first pipe and a second pipe when the pipes are in a drilling position, each pipe having a longitudinal axis, wherein in the drilling position, the longitudinal axes of the pipes are substantially aligned with a drilling axis, the second pipe circumferentially surrounding the first pipe, the system comprising: at least first and second diverter assemblies configured to form a seal around a respective pipe in the drilling position, wherein each diverter assembly comprises: a housing having a longitudinal axis substantially perpendicular to the drilling axis, a top wall, a bottom wall, the top and bottom walls defining respective openings, the openings surrounding the drilling axis and being configured to receive a pipe in the drilling position, the opening of the top wall being substantially aligned with the opening of the bottom wall, and wherein the top and bottom walls of the housing each define at least one inner projection extending toward the longitudinal axis of the housing; opposed first and second rams configured for axial movement relative to the longitudinal axis of the housing, first and second actuators respectively operatively coupled to the first and second rams, wherein the first and second actuators are configured to selectively move the first and second rams relative to the longitudinal axis of the housing; and first and second sealing members respectively operatively coupled to the first and second rams, the first and second sealing members being configured for engagement with a pipe in the drilling position, wherein the housings of the first and second diverter assemblies are operatively coupled such that the first pipe extends through the openings of the housings of both the first and second diverter assemblies, wherein the first diverter assembly is configured to form a seal around the first pipe, and wherein, upon engagement between the first and second sealing members of the first diverter assembly and the first pipe, the at least one inner projection of the top and bottom walls of the first diverter assembly is configured to cooperate with the first and second sealing members to form a seal around the first pipe and the openings of the top and bottom walls, and wherein the second diverter assembly is configured to form a seal around the second pipe, and wherein, upon engagement between the first and second sealing members of the second diverter assembly and the second pipe, the at least one inner projection of the top and bottom walls of the second diverter assembly is configured to cooperate with the first and second sealing members to form a seal around the second pipe and the openings of the top and bottom walls.

In additional exemplary aspects, the first pipe is a drill rod, and wherein the second pipe is an inner casing of a drill string.

In additional exemplary aspects, during advancement of the first pipe relative to the drilling axis, the second pipe is positioned such that it extends through the openings of the second housing but does not extend through an opening of the first housing.

In additional exemplary aspects, the housing of each diverter assembly comprises opposed first and second end walls connected to the top and bottom walls and spaced apart relative to the longitudinal axis of the housing, wherein each end wall defines a slot, and wherein the opposed first and second rams are respectively received within the slots of the first and second end walls of the housing.

In additional exemplary aspects, the first and second rams of each diverter assembly both have opposed proximal and distal ends, the proximal end of each ram being positioned more proximal to the drilling axis than the distal end of the ram relative to the longitudinal axis of the housing of the diverter assembly.

In additional exemplary aspects, the first and second sealing members of each diverter assembly both define a top surface, a bottom surface, and at least one side wall extending between the top and bottom surface, the at least one side wall defining a recessed portion configured for engagement with a respective pipe, wherein at least one of the top surface and the bottom surface of each sealing member is positioned at a selected acute angle relative to the longitudinal axis of the housing of the diverter assembly.

In additional exemplary aspects, the at least one inner projection of the top wall of each housing defines at least one engagement surface having an angular orientation complementary to the top surfaces of the first and second sealing members of the housing, and wherein the at least one inner projection of the bottom wall of each housing defines at least one engagement surface having an angular orientation complementary to the bottom surfaces of the first and second sealing members of the housing.

In additional exemplary aspects, the first and second actuators of each diverter assembly comprise hydraulic actuators. In additional exemplary aspects, the diverter system can comprise a hydraulic control system operatively coupled to the hydraulic actuators, and the hydraulic control system can be configured to prevent closure of the sealing members of the first diverter assembly while the sealing members of the second diverter assembly are closed. In additional exemplary aspects, the hydraulic control system can be configured to prevent closure of the sealing members of the second diverter assembly while the sealing members of the first diverter assembly are closed.

In additional exemplary aspects, each diverter assembly further comprises first and second chambers respectively secured to the first and second end walls of the housing of the diverter assembly and extending away from the drilling axis relative to the longitudinal axis of the housing, the first and second chambers being respectively positioned in communication with the slots defined by the first and second end walls of the housing and configured to permit axial movement of at least a portion of the first and second rams relative to the longitudinal axis of the housing.

In additional exemplary aspects, the top wall of the second housing defines a mounting element surrounding the opening in the top wall of the second housing and extending away from the longitudinal axis of the second housing, wherein the bottom wall of the first housing defines a mounting element surrounding the opening in the bottom wall of the first housing and extending away from the longitudinal axis of the first housing, and wherein the mounting element of the second housing is operatively coupled to the mounting element of the first housing.

In additional exemplary aspects, the first and second sealing members of each diverter assembly comprise urethane.

In additional exemplary aspects, the first and second sealing members of each diverter assembly are substantially wedge-shaped.

In a further exemplary aspect, a method is provided for forming seals around at least a first pipe and a second pipe when the pipes are in a drilling position, each pipe having a longitudinal axis, wherein in the drilling position, the longitudinal axes of the pipes are substantially aligned with a drilling axis, the second pipe circumferentially surrounding the first pipe, the method comprising: positioning first and second diverter assemblies such that the first pipe extends through both the first and second diverter assemblies and the second pipe extends through the second diverter assembly but does not extend through the first diverter assembly, each diverter assembly comprising: a housing having a longitudinal axis substantially perpendicular to the drilling axis, a top wall, a bottom wall, the top and bottom walls defining respective openings, the openings surrounding the drilling axis and being configured to receive a pipe in the drilling position, the opening of the top wall being substantially aligned with the opening of the bottom wall, and wherein the top and bottom walls of the housing each define at least one inner projection extending toward the longitudinal axis of the housing; opposed first and second rams configured for axial movement relative to the longitudinal axis of the housing, first and second actuators respectively operatively coupled to the first and second rams, wherein the first and second actuators are configured to selectively move the first and second rams relative to the longitudinal axis of the housing; and first and second sealing members respectively operatively coupled to the first and second rams, the first and second sealing members being configured for engagement with a pipe in the drilling position; selectively axially advancing the first and second rams of the first diverter assembly to form a seal around the first pipe, wherein, upon engagement between the first and second sealing members of the first diverter assembly and the first pipe, the at least one inner projection of the top and bottom walls of the first diverter assembly cooperates with the first and second sealing members to form a seal around the first pipe and the openings of the top and bottom walls; and selectively axially advancing the first and second rams of the second diverter assembly to form a seal around the second pipe, wherein, upon engagement between the first and second sealing members of the second diverter assembly and the second pipe, the at least one inner projection of the top and bottom walls of the second diverter assembly cooperates with the first and second sealing members to form a seal around the second pipe and the openings of the top and bottom walls.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A diverter assembly for forming a seal around a pipe positioned in a drilling position, the pipe having a longitudinal axis, wherein in the drilling position, the longitudinal axis of the pipe is substantially aligned with a drilling axis, the diverter assembly comprising:

a housing having a longitudinal axis substantially perpendicular to the drilling axis, a top wall, a bottom wall, and opposed first and second end walls connected to the top and bottom walls and spaced apart relative to the longitudinal axis of the housing, the top and bottom walls defining respective openings, the openings surrounding the drilling axis and being configured to receive the pipe in the drilling position, the opening of the top wall being substantially aligned with the opening of the bottom wall, wherein each end wall defines a slot;

first and second rams respectively received within the slots of the first and second end walls of the housing and configured for axial movement relative to the longitudinal axis of the housing, each ram having opposed proximal and distal ends, the proximal end of each ram being positioned more proximal to the drilling axis than the distal end of the ram relative to the longitudinal axis of the housing;

first and second actuators respectively operatively coupled to the distal ends of the first and second rams, wherein the first and second actuators are configured to selectively move the first and second rams relative to the longitudinal axis of the housing; and first and second sealing members respectively operatively coupled to the proximal ends of the first and second rams, each sealing member defining a top surface, a bottom surface, and at least one side wall extending between the top and bottom surface, the at least one side wall defining a recessed portion configured for engagement with the pipe, wherein the top and bottom walls of the housing each define at least one fixed inner projection extending toward the longitudinal axis of the housing, and wherein, upon engagement between the first and second sealing members and the pipe, the at least one inner projection of the top wall and the at least one inner projection of the bottom wall are configured to cooperate with the first and second sealing members to form a seal around the pipe and the openings of the top and bottom walls of the housing, wherein at least one of the top surface and the bottom surface of each sealing member is positioned at a selected acute angle relative to the longitudinal axis of the housing, and wherein the at least one inner projection of the top wall defines at least one engagement surface having an angular orientation complementary to the top surfaces of the first and second sealing members, and wherein the at least one inner projection of the bottom wall defines at least one engagement surface having an angular orientation complementary to the bottom surfaces of the first and second sealing members.

2. The diverter assembly of claim 1, wherein the first and second actuators comprise hydraulic actuators.

3. The diverter assembly of claim 2, further comprising first and second chambers respectively secured to the first and second end walls of the housing and extending away from the drilling axis relative to the longitudinal axis of the housing, the first and second chambers being respectively positioned in communication with the slots defined by the first and second end walls of the housing and configured to permit axial movement of at least a portion of the first and second rams relative to the longitudinal axis of the housing.

4. The diverter assembly of claim 1, wherein at least one of the top and bottom walls of the housing defines a mounting element surrounding an opening of the housing and extending away from the longitudinal axis of the housing.

5. The diverter assembly of claim 1, wherein the first and second sealing members comprise urethane.

6. The diverter assembly of claim 1, wherein the first and second sealing members are substantially wedge-shaped.

7. A diverter system for forming seals around at least a first pipe and a second pipe when the pipes are in a drilling position, each pipe having a longitudinal axis, wherein in the drilling position, the longitudinal axes of the pipes are substantially aligned with a drilling axis, the second pipe circumferentially surrounding the first pipe, the system comprising:

at least first and second diverter assemblies configured to form a seal around a respective pipe in the drilling position, wherein each diverter assembly comprises:

a housing having a longitudinal axis substantially perpendicular to the drilling axis, a top wall, a bottom wall, the top and bottom walls defining respective openings, the openings surrounding the drilling axis and being configured to receive a pipe in the drilling position, the opening of the top wall being substantially aligned with the opening of the bottom wall, and wherein the top and bottom walls of the housing each define at least one fixed inner projection extending toward the longitudinal axis of the housing;

opposed first and second rams configured for axial movement relative to the longitudinal axis of the housing, first and second actuators respectively operatively coupled to the first and second rams, wherein the first and second actuators are configured to selectively move the first and second rams relative to the longitudinal axis of the housing; and first and second sealing members respectively operatively coupled to the first and second rams, the first and second sealing members being configured for engagement with a pipe in the drilling position, wherein the housings of the first and second diverter assemblies are operatively coupled such that the first pipe extends through the openings of the housings of both the first and second diverter assemblies, wherein the first diverter assembly is configured to form a seal around the first pipe, and wherein, upon engagement between the first and second sealing members of the first diverter assembly and the first pipe, the at least one inner projection of the top wall and the at least one inner projection of the bottom wall of the first diverter assembly are configured to cooperate with the first and second sealing members to form a seal around the first pipe and the openings of the top and bottom walls, wherein the second diverter assembly is configured to form a seal around the second pipe, and wherein, upon engagement between the first and second sealing members of the second diverter assembly and the second pipe, the at least one inner projection of the top wall and the at least one inner projection of the bottom wall of the second diverter assembly are configured to cooperate with the first and second sealing members to form a seal around the second pipe and the openings of the top and bottom walls, wherein the first and second sealing members of each diverter assembly both define a top surface, a bottom surface, and at least one side wall extending between the top and bottom surface, the at least one side wall defining a recessed portion configured for engagement with a respective pipe, wherein at least one of the top surface and the bottom surface of each sealing member is positioned at a selected acute angle relative to the longitudinal axis of the housing of the diverter assembly, and wherein the at least one inner projection of the top wall of each housing defines at least one engagement surface having an angular orientation complementary to the top surfaces of the first and second sealing members of the housing, and wherein the at least one inner projection of the bottom wall of each housing defines at least one engagement surface having an angular orientation complementary to the bottom surfaces of the first and second sealing members of the housing.

8. The diverter system of claim 7, wherein the first pipe is a drill rod, and wherein the second pipe is an inner casing of a drill string.

9. The diverter system of claim 7, wherein during advancement of the first pipe relative to the drilling axis, the second pipe is positioned such that the second pipe extends through the openings of the second housing but does not extend through an opening of the first housing.

10. The diverter system of claim 7, wherein at least one of the top surface and the bottom surface of the sealing members of each diverter assembly is positioned at a selected acute angle relative to the longitudinal axis of the housing of the diverter assembly.

11. The diverter system of claim 10, wherein the housing of each diverter assembly comprises opposed first and second end walls connected to the top and bottom walls and spaced apart relative to the longitudinal axis of the housing, wherein each end wall defines a slot, and wherein the opposed first and second rams are respectively received within the slots of the first and second end walls of the housing.

12. The diverter system of claim 11, wherein the first and second rams of each diverter assembly both have opposed proximal and distal ends, the proximal end of each ram being positioned more proximal to the drilling axis than the distal end of the ram relative to the longitudinal axis of the housing of the diverter assembly.

13. The diverter system of claim 7, wherein the first and second actuators of each diverter assembly comprise hydraulic actuators.

14. The diverter system of claim 13, wherein each diverter assembly further comprises first and second chambers respectively secured to the first and second end walls of the housing of the diverter assembly and extending away from the drilling axis relative to the longitudinal axis of the housing, the first and second chambers being respectively positioned in communication with the slots defined by the first and second end walls of the housing and configured to permit axial movement of at least a portion of the first and second rams relative to the longitudinal axis of the housing.

15. The diverter system of claim 13, further comprising a hydraulic control system operatively coupled to the hydraulic actuators, wherein the hydraulic control system is configured to prevent closure of the sealing members of the first diverter assembly while the sealing members of the second diverter assembly are closed.

16. The diverter system of claim 15, wherein the hydraulic control system is configured to prevent closure of the sealing members of the second diverter assembly while the sealing members of the first diverter assembly are closed.

17. The diverter system of claim 7, wherein the top wall of the second housing defines a mounting element surrounding the opening in the top wall of the second housing and extending away from the longitudinal axis of the second housing, wherein the bottom wall of the first housing defines a mounting element surrounding the opening in the bottom wall of the first housing and extending away from the longitudinal axis of the first housing, and wherein the mounting element of the second housing is operatively coupled to the mounting element of the first housing.

18. The diverter system of claim 7, wherein the first and second sealing members of each diverter assembly comprise urethane.

19. The diverter system of claim 7, wherein the first and second sealing members of each diverter assembly are substantially wedge-shaped.

20. A method for forming seals around at least a first pipe and a second pipe when the pipes are in a drilling position, each pipe having a longitudinal axis, wherein in the drilling position, the longitudinal axes of the pipes are substantially aligned with a drilling axis, the second pipe circumferentially surrounding the first pipe, the method comprising:

positioning first and second diverter assemblies such that the first pipe extends through both the first and second diverter assemblies and the second pipe extends through the second diverter assembly but does not extend through the first diverter assembly, each diverter assembly comprising:

a housing having a longitudinal axis substantially perpendicular to the drilling axis, a top wall, a bottom wall, the top and bottom walls defining respective openings, the openings surrounding the drilling axis and being configured to receive a pipe in the drilling position, the opening of the top wall being substantially aligned with the opening of the bottom wall, and wherein the top and bottom walls of the housing each define at least one fixed inner projection extending toward the longitudinal axis of the housing;

opposed first and second rams configured for axial movement relative to the longitudinal axis of the housing, first and second actuators respectively operatively coupled to the first and second rams, wherein the first and second actuators are configured to selectively move the first and second rams relative to the longitudinal axis of the housing; and first and second sealing members respectively operatively coupled to the first and second rams, the first and second sealing members being configured for engagement with a pipe in the drilling position, wherein the first and second sealing members of each diverter assembly both define a top surface, a bottom surface, and at least one side wall extending between the top and bottom surface, the at least one side wall defining a recessed portion configured for engagement with a respective pipe, wherein at least one of the top surface and the bottom surface of each sealing member is positioned at a selected acute angle relative to the longitudinal axis of the housing of the diverter assembly, and wherein the at least one fixed inner projection of the top wall of each housing defines at least one engagement surface having an angular orientation complementary to the top surfaces of the first and second sealing members of the housing, and wherein the at least one fixed inner projection of the bottom wall of each housing defines at least one engagement surface having an angular orientation complementary to the bottom surfaces of the first and second sealing members of the housing;

selectively axially advancing the first and second rams of the first diverter assembly to form a seal around the first pipe, wherein, upon engagement between the first and second sealing members of the first diverter assembly and the first pipe, the at least one inner projection of the top wall and the at least one inner projection of the bottom wall of the first diverter assembly cooperate with the first and second sealing members to form a seal around the first pipe and the openings of the top and bottom walls; and selectively axially advancing the first and second rams of the second diverter assembly to form a seal around the second pipe, wherein, upon engagement between the first and second sealing members of the second diverter assembly and the second pipe, the at least one inner projection of the top wall and the at least one inner projection of the bottom wall of the second diverter assembly cooperate with the first and second sealing members to form a seal around the second pipe and the openings of the top and bottom walls.

* * * * *